United States Patent [19]

Bruck

[11] Patent Number: 4,635,798

[45] Date of Patent: Jan. 13, 1987

[54] FLASH SORTING APPARATUS

[75] Inventor: Horst Bruck, Vandalia, Ill.

[73] Assignee: John Crane-Houdaille, Inc., Morton Grove, Ill.

[21] Appl. No.: 650,056

[22] Filed: Sep. 13, 1984

[51] Int. Cl.[4] ..... B07C 5/00

[52] U.S. Cl. ..... 209/644; 198/438; 209/645; 209/920; 209/932; 209/940; 221/278

[58] Field of Search ..... 209/44.2, 644, 645, 209/920, 924, 932, 940; 198/380, 391, 438; 221/159, 160, 278, 157; 425/217

[56] References Cited

U.S. PATENT DOCUMENTS

| | | | |
|---|---|---|---|
| 2,417,878 | 3/1947 | Luzietti et al. | 209/644 |
| 2,972,410 | 2/1961 | Schulte et al. | 209/644 |
| 3,012,651 | 12/1961 | Hawkes | 198/380 |
| 3,485,333 | 12/1969 | Leslie | 221/160 |
| 3,612,271 | 10/1971 | Behling | 209/644 |

*Primary Examiner*—Robert B. Reeves
*Assistant Examiner*—Edward M. Wacyra
*Attorney, Agent, or Firm*—Robert V. Jambor

[57] ABSTRACT

An apparatus and method utilizing pressurized air discharged through nozzles to segregate a mixture of elements having either different geometrical characteristics or different masses. The mixture is placed in a container having a conveyor track, and is forced to move along the track, across a primary nozzle which forms the mixture into a single layer. The mixture then moves across a blow-off nozzle which propels one set of elements off the track and out of the container while the other remains within the container. A two stage separation may be used to optimize efficiency.

10 Claims, 4 Drawing Figures

FLASH SORTING APPARATUS

BACKGROUND OF THE INVENTION

1. Field of the Invention

This invention relates to an apparatus and method to be used to automatically segregate a mixture of articles, particularly a mixture of molded articles and associated flash, wherein the molded articles and flash are separate sets of elements, but remain commingled.

In manufacturing molded articles such as rubber parts, a portion of the charge often overflows from the mold cavity at the parting line of the mold. This overflow, or flash, generally remains a part of the molded product after the molding operation has been completed. A variety of means are available to cleave the flash from the article. In one means, the molded articles are chilled and the flash then mechanically broken away through tumbling or the like. However, once this deflashing operation has been completed, the parts and flash remain commingled, and must be separated.

2. Summary of the Invention

The present invention is directed to solving the problem of parting and collecting molded articles and flash after the article and flash have previously been cleaved. This invention takes advantage of the differences in geometry and mass of the molded articles and flash.

A mixture of molded articles and flash is held in a container having a conveyor track. The mixture moves along the track past a primary nozzle which blows the mixture into a single layer. Upstream, the mixture moves past a blow-off nozzle which blows either the article or the flash off the track and out of the bowl.

The invention may be used for a variety of molded articles, and is adapatable to rubber, plastic, and metal articles. It offers a fast and efficient means for sorting molded articles and flash, and it achieves nearly a complete sorting of the molded articles and flash.

DETAILED DESCRIPTION OF THE INVENTION

Apparatus embodying the present invention is illustrated in the accompanying drawings. Typically it is utilized in connection with a molding operation in which rubber or other raw material is formed into machine components, such as seals, bellows, gaskets, or the like.

Figure 1:
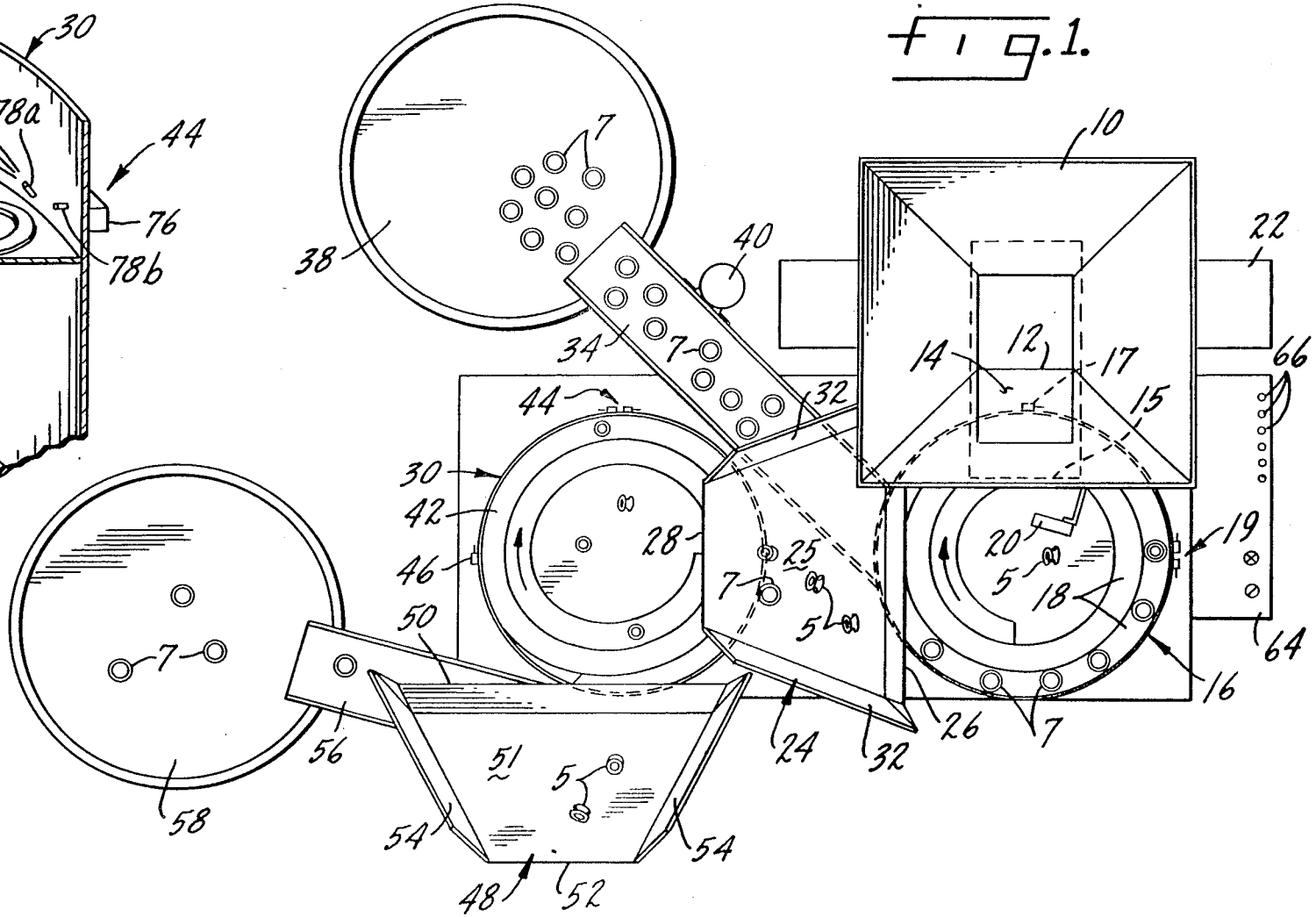
FIG. 1 is a top view of a flash sorting apparatus embodying this invention.
Figure 4:
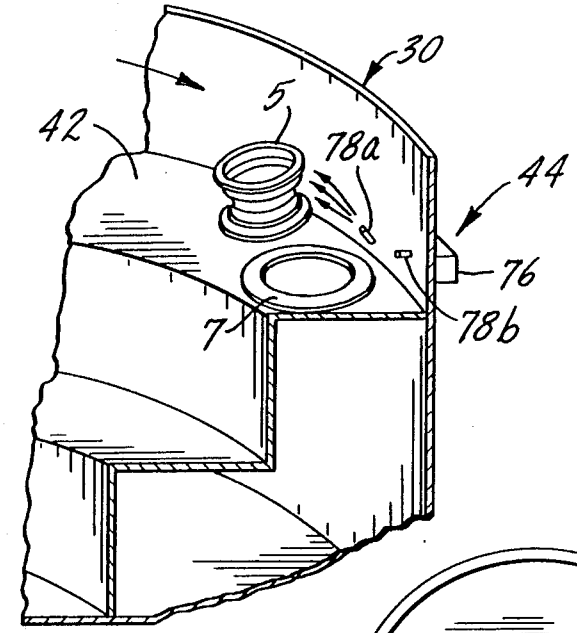
FIG. 4 is a partial enlarged perspective view of the interior of a bowl, showing its spiral track.
Figure 2:
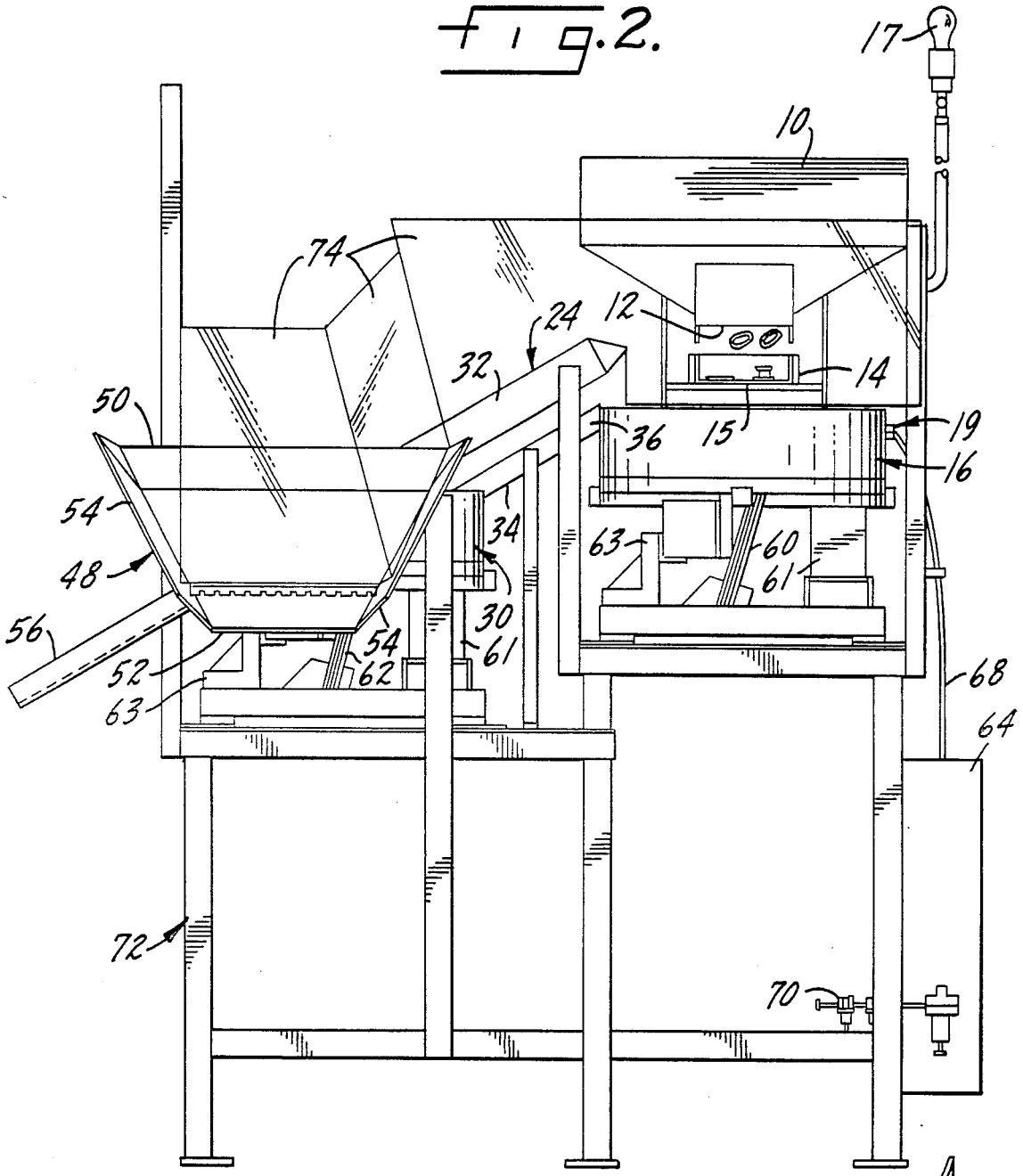
FIG. 2 is a side elevational view of a flash sorting apparatus embodying this invention.

Molded articles and flash previously cleaved and formed into a random mixture of the molded articles 5 and flash 7 is placed in a storage hopper 10. An outlet 12 from the storage hopper 10, shown in FIG. 2, opens above a horizontal chute generally designated 14. As best seen in FIG. 2, chute 14 has an open end 15 over a first bowl 16, having a conveyor track 18 which spirals upwards along the interior of the bowl 16 to the top of its rim. This spiral track 18 is shown in FIGS. 1 and 4. The bowl 16 is an electrically vibrated bowl and, when vibrated, materials within the bowl travel at a steady rate up the spiral track or ramp 18 toward its upper terminus.

Regulating means are provided to control the feed of the mixture into the first bowl 16. In the illustrated embodiment, the regulating means comprises a conventional electric eye 20 and a first controller 22. Controller 22 in the form of a variable transformer regulates flow through outlet 12 onto chute 14 and into bowl 16 in any known manner, such as by vibrating chute 14 under hopper 10 at varying frequency. Electric eye 20 is arranged to sense when the bowl is full to de-energize the controller. It may also sense when the bowl is empty and, for example, energize light 17.

A first transfer chute 24, defining a planar surface 25, has a first edge 26 positioned above the first bowl 16. From the first edge 26, the surface 25 slopes downwardly to its second edge 28; the second edge 28 is positioned above a second bowl 30. The first transfer chute 24 has side guards 32 sloping generally upwardly to keep the materials present in the chute from falling off the sides.

A first discharge chute 34 is positioned in operative relation to the top rim of the first bowl 16. As shown in FIG. 2, the first edge 36 of the discharge chute abuts the first bowl 16 near the point where the spiral track 18 reaches its highest point adjacent the open upper end of the bowl. Materials reaching the top of the spiral track will be deposited on the discharge chute. The discharge chute slopes downwardly. Therefore, materials deposited on the chute will travel down the discharge chute to be deposited in a first collection drum 38. To facilitate this travel of this set of elements, the preferred embodiment includes a vibrator 40, to vibrate the chute 34 and the materials thereon.

A second vibrating bowl 30 is of the same construction as the first bowl 14. Best seen in FIG. 4, it has a track 42 which spirals upward from the interior of the bowl to the top of its rim.

A final transfer chute 48 is constructed similarly to the first transfer chute 24, having a first edge 50 positioned above the second bowl 30, and a planar surface 51. It slopes downwardly to its second edge 52, which is positioned above a collecting means, such as a fiber drum or the like (not shown). The chute also has side guards 54 to keep materials on surface 51 from falling off the sides of the chute. In both transfer chutes 24, 48, the first edge 26, 50 is wide, approximating the diameter of the bowl 16, 30; the width decreases towards the second edge 28, 52.

A second discharge chute 56 leads from the second bowl 30 to a second collection drum 58. Like the first bowl 16 and the first discharge chute 34, the second discharge chute 56 abuts the second bowl 30 near the point where the spiral track 42 reaches its highest point. Materials traveling up spiral track or ramp 42 will be deposited on the discharge chute 56. The discharge chute 56 slopes downwardly and the materials will travel down the chute to second collection drum 58. A vibrator may be incorporated to facilitate this travel.

Vibration of bowls 16 and 30 is accomplished in any suitable manner. As illustrated, bowls 16 and 30 are supported upon vertical legs 61, 63. Vibratory motion is imported to the bowls through means 60 and 62 which may be electrically operated.

Shown in FIG. 2 is a support structure 72 for the apparatus. Generally, the support structure may be of any form, so long as it maintains the basic spatial relationship of the parts of the apparatus. Guards 74 are provided in the preferred embodiment to confine the articles and flash.

Figure 3:
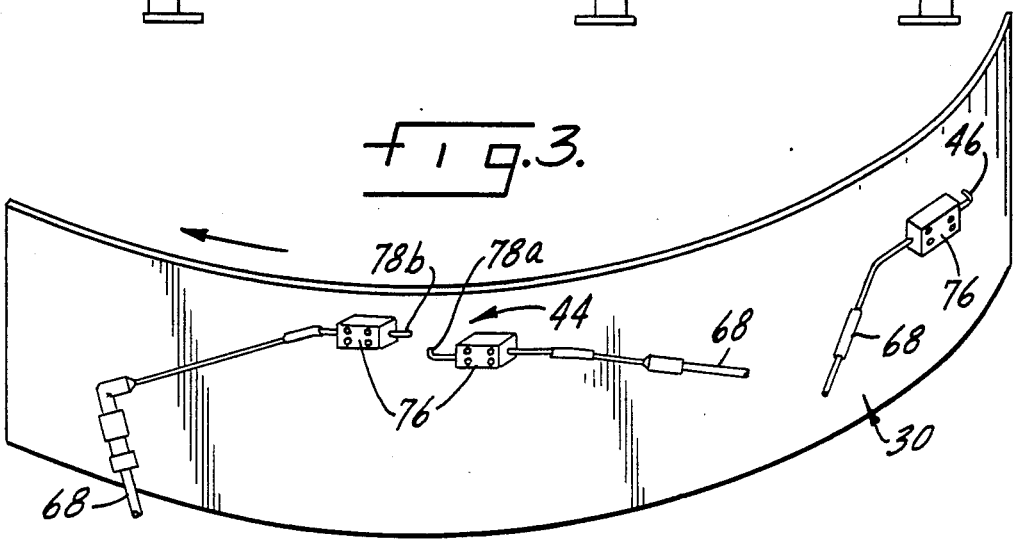
FIG. 3 is a partial enlarged perspective view of the exterior of a bowl and nozzles.

In accordance with the present invention, the apparatus includes a blow-off system comprising a source of air under pressure 70, controller 64, air lines or conduits 68, and a series of primary and blow-off nozzles associated with bowls 16 and 30, and best seen in FIGS. 3 and 4.

Bowl 16 is provided with a primary nozzle 17, a set of blow-off nozzles 19. These nozzles extend through the outer wall of the bowl into the interior along spiral ramp 18. As illustrated, the primary nozzle and blow-off nozzle set are disposed about 90° apart. This location is not critical so long as they are spaced apart sufficiently to separate their respective functions.

Bowl 30 is similarly provided with a primary nozzle 46 and a pair of blow-off nozzles spaced approximately 90° from the primary nozzle along the bowl periphery. Both bowl arrangements are identical and illustration of the bowl 30 in FIGS. 3 and 4 is representative.

FIGS. 3 and 4 show, in detail, the nozzle arrangements. The primary nozzle 46 and the set of blow-off nozzles 44 are held to the bowl 30 by means of mounting brackets 76. As best seen in FIG. 4, each nozzle is in the form of a tube such as tube 78*a* and 78*b* which extend through apertures in the bowl, near the top rim of the bowl. Only a short portion of each tube extends through the rim of the bowl. One tube 78*a* extends through the rim at an upward angle, an angle of 45° from a plane parallel to the plane of the ramp 82 of the bowl 30. It should also be noted that conduits 68 which connect the nozzles to the air supply are adpated to accommodate the vibratory motion of the bowls.

Control box 64 has an array of selector toggle switches 66. These selector toggle switches operate air pressure regulators within the control box to control the pressure and air flow to the two sets of blow-off nozzles 19, 44 and the primary nozzles 17 and 46. The air pressure and flow exerted through the nozzles may differ for the first bowl 16 and second bowl 30, as well as for the primary and blow-off nozzles. The primary and blow-off nozzles serve different functions, and the optimum air pressures for each may differ. One apparatus need not be limited to any particular air pressure: it may be adjusted to deliver the air pressure that is optimal for the geometry and mass of the articles being parted; by providing a variety of air pressure settings on one apparatus, one apparatus may be adjusted to be used to sort a variety of molded articles.

The operation of the invention is as follows:

A mixture of molded articles 5 and flash 7, having previously been separated, is placed in storage hopper 10. The hopper chute 11 vibrates and the mixture falls into the first bowl 16. The regulating means, including the electric eye 20, regulates the frequency by which the mixture is introduced into the first bowl 16.

The vibrating means 60 for the first bowl causes the mixture to move upward along the spiral track 18. As mixture passes the primary nozzle of the first bowl, the primary nozzle directs an air jet against the mixture. If any element of the mixture is layered on top of any of the molded articles, this air jet blows the additional layers off and returns to the interior of the bowl. Beyond this point, there is a single layer on the spiral track, and the vibrating motion causes this single layer to move downstream to the blow-off nozzles 19.

The controller 64 is set to supply air to one of the blow-off nozzles 19. It emits an air jet which impinges on only the part 5, not the flash 7. The air jet is directed against the molded articles, which are generally much taller than the flash. The parts are blown off the spiral track 18, and across the first bowl 16 to the first transfer chute 24. The flash passes beneath the air jet and remains on the spiral track 18 until it reaches the top of the bowl's rim. The flash is then deposited on the first discharge chute 34, from where it is deposited in the first collection drum 38. This operation substantially sorts the mixture. It is about 90–98% effective to separate the parts and flash.

The parts on the first transfer chute 24 are deposited in the second bowl 30 for an additional sorting operation. The vibrating means 62 for the second bowl, causes the mixture to move up the spiral track 42, and pass the primary nozzle 46. Nozzle 46 directs an air jet at the mixture to create a single layer of the elements on the track. Downstream, this single layer passes the second set of blow-off nozzles 44. Again controller 64 has been set to supply air to one of the nozzles 78*a* or 78*b*. This nozzle directs an air jet against the part and blows it from the track and flings it across the second bowl 30 to the final transfer chute 48. The shorter elements, the flash, pass beneath the air jet and remain on the spiral track 42. The flash continues to move downstream along the track to the top of the spiral where it is deposited on the second discharge chute 56. The flash then travels down the second discharge chute 56 and is deposited in the second collection drum 58.

In this embodiment of the invention, the sorting is accomplished by the differences in the geometry of the molded articles and the flash. The articles are generally much taller than the flash. The tubes 78*a* and 78*b* are positioned so that the air jet passes over the flash and only hits the molded article.

As indicated, the preferred embodiment of the invention features two blow-off nozzles in each bowl, and the air pressures to these nozzles may be adjusted and one or the other used depending on the requirements of the sorting operation.

The optimal angle of the tube 78 of the blow-off nozzles 19, 46 can vary, as can the optimal height of the tube from the spiral tracks 18, 42 depending, among other things, upon the geometry of the articles being parted.

Use of tube 78*a* or the tube 78*b* depends on the part being separated. Of course, other similar tubes could be added and positioned to impinge air upon a passing array of parts. The position and angle would depend upon the shape of the article and its weight.

It is also contemplated that pressure to primary nozzles 17 and 46 can vary from 20 to 50 psi. About 30 psi has been found effective for most operations. Similarly, the pressure supplied to the blow-off nozzles may be varied from zero to the maximum pressure supplied to the apparatus. It has been found that pressures in the range of between about 30 to about 50 psi are effective using tubes having an 0.062 inch inside diameter. Also a simple mechanical barrier or the the like could be substituted for the primary nozzles 17 and 46. The barrier could be spaced above the spiral track to insure that elements are passed therealong in a single layer.

The invention may also be used to take advantage of the mass differences of the elements instead of the geometric differences. Generally, the mass of the molded articles is greater than that of the flash. Instead of blowing the molded articles away from the flash, the blow-off nozzles 19, may blow the lighter flash out of the bowl 16. The molded articles would travel down the discharge chute 34, and collect in the collection drum 38. The flash would be directed to chute 24 which could be repositioned to deliver the flash to a collector drum rather than to second bowl 30. Of course, a chute (not shown) could be provided to carry the parts from the terminus of spiral 18 to bowl 30 for two stage sorting.

Additional modifications and/or additions may be included by those skilled in the art without departing from the scope of the invention as defined by the claims.

I claim:

1. A method of sorting a mixture of two sets of solid elements comprising the steps of;

placing the mixture in an open topped container having an upper rim and a track at least a portion of which is disposed below said rim;

causing the mixture to move along the track;

forming the mixture into a single layer; and passing said layer across an air jet from a blow-off nozzle at said portion of said track disposed below said rim to blow substantially all of one set of said elements off the track and out of the container over said upper rim and to a transfer chute having a first edge positioned above the upper rim of the open topped container.

2. A method as claimed in claim 1 wherein forming the mixture into a single layer is accomplished by blowing portions of the mixture in excess of a single layer off said layer into said container with an air jet.

3. A method as claimed in claim 2 including collecting one of said sets of elements blown off said track in a second open topped container having an upper rim and a track at least a portion of which is disposed below said rim, causing said elements to move along said track in said second container, forming said elements into a signle layer, passing said elements across an air jet from a blow-off nozzle at said portion of said track disposed below said rim to blow each of said one set of elements out of said second container over said upper rim.

4. An apparatus for sorting a mixture of two sets of solid elements, wherein the sets are separate sets of elements, comprising:

a source of pressurized air;

an open topped container to hold the two sets of solid elements having an upper rim;

a track within the container; along which the mixture may move at least a portion of which is disposed below said upper rim; means for causing said mixture to move there along;

means to form the mixture on the track into a single layer;

a blow-off nozzle, extending towards the interior of the container at said portion of said track disposed below said rim, and being operably connected to the source of pressurized air, to direct an air jet against one set of the elements of the mixture to blow substantially all of said one set of elements off the track and out of the container over said upper rim; and a transfer chute having a first edge positioned above the upper rim of the open topped container to receive said one set of elements as they are blown out of the container.

5. The apparatus according to claim 4 wherein one set of elements are molded articles and have a greater height than that of the other set, and the blow-off nozzle is disposed so as to direct an air jet against the articles to blow the articles off the track and out of the container over said upper rim.

6. The apparatus according to claim 5 wherein the container is a cylindrical bowl and the track is a spiral track leading upwards from the interior of the bowl to the top of its rim.

7. The apparatus according to claim 5 wherein the means for causing the mixture to move along the track is a vibrating means to vibrate said container and said means to form a single layer is an air jet nozzle extending into said container upstream of said blow-off nozzle.

8. The apparatus according to claim 7, wherein a second container is provided, said substantially all of said one set of solid elements is blown off the track of said first container into said second open topped container, said second container has an upper rim and includes:

a track which said elements may move at least a portion of which is disposed below said upper rim; means causing said elements to move therealong;

means to form said elements on said track into a single layer;

a blow-off nozzle extending toward the interior of said second container at said portion of said track disposed below said upper rim and operatively connected to said source of pressurized air to direct an air jet against said set of elements in said second container to blow said elements off the track and out of said second container over said upper rim;

the apparatus further comprising a final transfer chute having a first edge positioned above the upper rim of the second open topped container to receive said set of elements as they are blown out of the second container.

9. The apparatus according to claim 4 wherein one set of elements are molded articles and have a greater weight than that of the other set, and the air jet directed by the blow-off nozzle blows the lighter set off said track and out of the container over said upper rim.

10. The apparatus according to claim 9 wherein the container is a bowl and the track is a spiral track leading upwards from the interior of the bowl to the top of its rim.

* * * * *